US006089473A

United States Patent [19]

Keim

[11] Patent Number: 6,089,473

[45] Date of Patent: Jul. 18, 2000

[54] VALVE, IN PARTICULAR A FUEL INJECTION VALVE

[75] Inventor: Norbert Keim, Löchgau, Germany

[73] Assignee: Robert Bosch GmbH, Stuttgart, Germany

[21] Appl. No.: 09/066,420

[22] PCT Filed: Aug. 30, 1997

[86] PCT No.: PCT/DE97/01905

§ 371 Date: Apr. 30, 1998

§ 102(e) Date: Apr. 30, 1998

[87] PCT Pub. No.: WO98/11341

PCT Pub. Date: Mar. 19, 1998

[30] Foreign Application Priority Data

Sep. 12, 1996 [DE] Germany ..... 196 37 103

[51] Int. Cl.[7] ..... F02M 61/00

[52] U.S. Cl. ..... 239/533.12; 239/466; 239/487; 239/494; 239/585.1; 239/900

[58] Field of Search ..... 239/466, 472, 239/473, 468, 469, 490–497, 583, 584, 585.1, 533.12, 900, 596, 486, 487, 489

[56] References Cited

U.S. PATENT DOCUMENTS

| | | | |
|---|---|---|---|
| 2,920,831 | 1/1960 | Johnsyn, Jr. | 239/466 X |
| 3,081,952 | 3/1963 | Woodward et al. | 239/466 X |
| 3,326,470 | 6/1967 | Loudin et al. | 239/466 X |
| 5,178,331 | 1/1993 | Schuerz | 239/466 X |
| 5,570,841 | 11/1996 | Pace et al. | 239/533.12 X |

FOREIGN PATENT DOCUMENTS

| | | |
|---|---|---|
| 0 057 407 | 8/1982 | European Pat. Off. . |
| 0 435 973 | 7/1991 | European Pat. Off. . |
| 57-183559 | 11/1982 | Japan . |

*Primary Examiner*—Andres Kashnikow
*Assistant Examiner*—Steven J. Ganey
*Attorney, Agent, or Firm*—Kenyon & Kenyon

[57] ABSTRACT

A valve includes a swirl-inducing arrangement positioned downstream from a valve seat. The swirl-inducing arrangement is shaped so that at least two radially offset and oppositely directed flows can be induced in a fluid to be sprayed. Swirl-induced shearing forces that cause turbulence occur in the boundary areas of the flow components having different directions. A uniform and extremely fine atomization of the fluid, specifically a fuel, is possible with this valve without any additional energy input. The valve is especially suitable for use in fuel injection.

10 Claims, 4 Drawing Sheets

FIG. 8
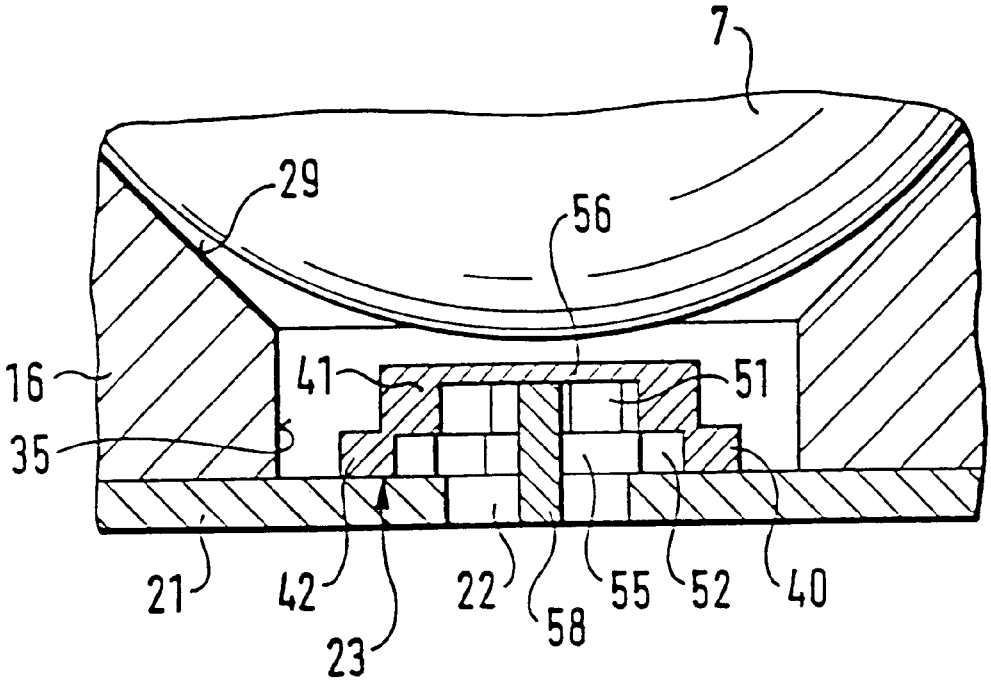
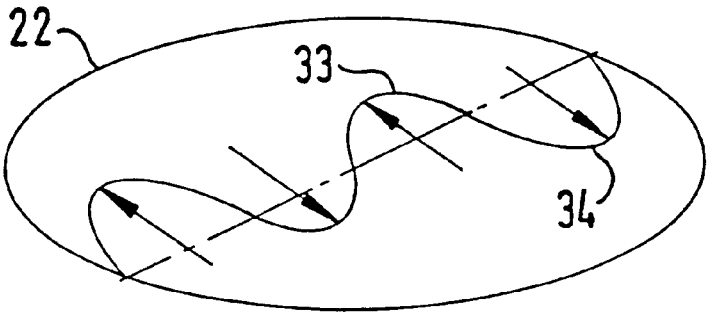
FIG. 9

VALVE, IN PARTICULAR A FUEL INJECTION VALVE

FIELD OF THE INVENTION

The present invention relates to a valve, and in particular to an injection valve.

BACKGROUND INFORMATION

European Patent Application No. 0 057 407 describes a valve, in particular a fuel injection valve, having a swirl body downstream from a valve closing body and upstream from a spray orifice; this swirl body imparts a swirl component to the fuel to be sprayed. The resulting swirling flow yields a to better fuel turbulence, so that finer fuel atomization is achieved in comparison with a constricted spray flow.

Likewise, a fuel injection valve having a turbulence-producing is device upstream from an outlet orifice of the valve is described in Japanese Patent Application No. 57-183559. This turbulence-producing device has a plurality of swirl grooves, all of which have the same orientation and serve to impart a swirl component to the fuel for an improved turbulence. In addition, atomization of fuel can be further improved using tangential air inlet channels with which a swirl is also imparted to the air.

In addition, swirl channels, swirl grooves or other swirl devices are also conventionally provided in valves and are situated, for example, directly on the valve needle or on the valve closing body, i.e., they are also upstream from the valve seat face. All these conventional swirl arrangements have in common the fact that all the fluid to be sprayed out is influenced by the swirl elements in only one direction or orientation.

An arrangement for atomizing liquids is also described in European Patent Application No. 0 435 973, which is provided on the outlet side of an injection valve. The liquid to be sprayed flows from an outlet orifice of the injection valve and then flows through the atomizer arrangement which is supplied with air through air lines. The atomizer arrangement contains two turbulence-producing planes, which follow one another axially and into which the air is injected. The turbulence-producing planes are designed so that opposite directions of rotation are imparted to the two developing air turbulences. The fluid, in particular a fuel, is also entrained by the turbulent air, and a swirl is imparted to the fluid to some extent, although this is achieved only through the energy stored in the air. Due to the opposite directions of rotation of the turbulent flows, the rotational movement of the overall flow as it leaves the atomizer arrangement is eliminated.

SUMMARY OF THE INVENTION

The valve according to the present invention, in particular a fuel injection valve is advantageous in that the quality of atomization of a fluid, in particular of a fuel, to be sprayed and finely atomized is further improved in a simple and inexpensive manner without any additional auxiliary energy input. According to the present invention, this is achieved providing that swirl-inducing means on the valve downstream of the valve seat so that at least two main flows are formed. These main flows run with at least a partial radial offset relative to one another, and thus they also flow through at least one outlet orifice of the valve. The two main flows have different directions. In the area of contact between the two flows, high shearing forces, having a positive effect on atomization, occur due to the different orientations. Thus with simple constructive means, swirl-induced shearing forces that ensure atomization-enhancing turbulence are produced in the fluid due to the high opposing velocities of the individual flows. Consequently, when the valve is used as a fuel injection valve, the exhaust gas emission of an internal combustion engine and the consumption of fuel can be reduced in an advantageous manner.

In an advantageous manner, the swirl-inducing means are provided as swirl caps directly on an orifice plate. Swirl channels projecting tangentially into an inside flow area of the swirl cap are advantageously arranged in at least two axially successive layers, with different radial distances of the swirl canals from the longitudinal axis of the valve being provided in the individual layers. Furthermore, the swirl channels differ in orientation from one layer to another layer. Such arrangement produces very simply radially nested fluid flows in opposite directions with the desired turbulence being created in their boundary areas due to increased shearing forces.

It is especially advantageous that different jet-producing devices with different jet angles (e.g., solid cone, hollow cone) can be achieved effectively through simple design measures on the swirl cap.

BRIEF DESCRIPTION OF THE DRAWINGS

FIG. 8 shows a fourth exemplary embodiment of the swirl-inducing means in the form of the swirl cap.

FIG. 9 shows a schematic diagram of an idealized velocity distribution in the outlet orifice of the swirl cap illustrated in FIG. 6.

DETAILED DESCRIPTION OF THE DRAWINGS

Figure 1:
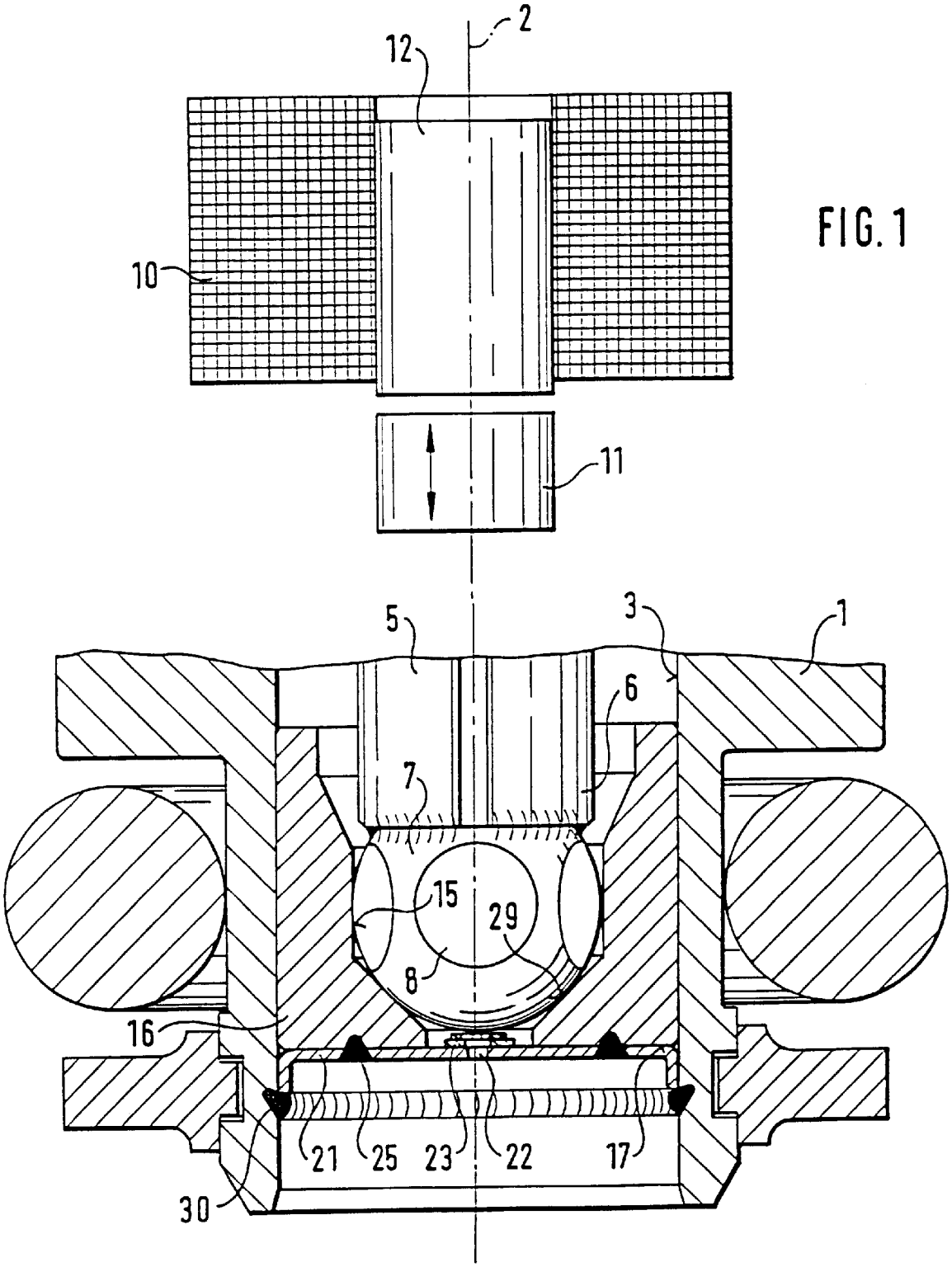
FIG. 1 shows a partial view of a valve having swirl-inducing means according to the present invention.
Figure 6:
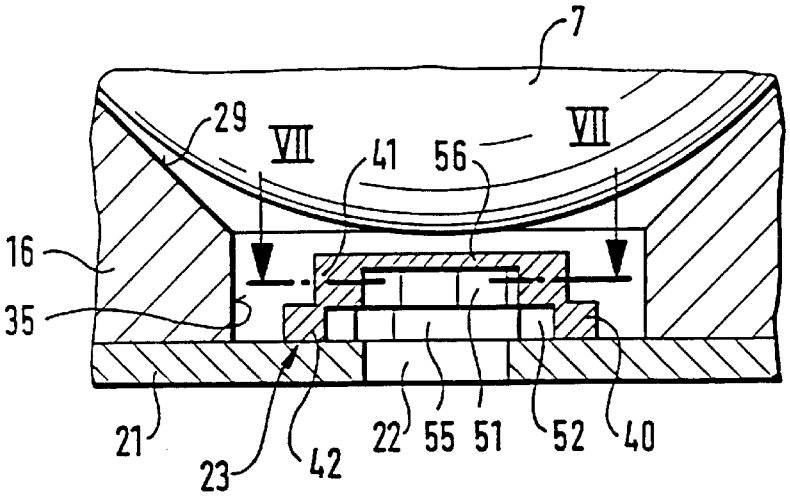
FIG. 6 shows a third exemplary embodiment of the swirl-inducing means in the form of a swirl cap.

FIG. 1 shows a partial view of an exemplary embodiment of a valve in example of swirl-inducing means in the form of a swirl cap, and FIG. 9 shows a schematic diagram of an idealized velocity distribution in the outlet orifice of the swirl cap according to FIG. 6.

DESCRIPTION OF THE EMBODIMENTS

FIG. 1 shows as one embodiment a partial view of a valve in the form of an injection valve for fuel injection systems in internal combustion engines with mixture compression and external ignition. The injection valve has a tubular valve seat carrier 1 with a longitudinal orifice 3 concentric with the longitudinal axis 2 of the valve. A tubular valve needle 5, for example, is arranged in longitudinal orifice 3 and is connected at its downstream end 6 to a valve closing body 7. Valve closing body 7 is spherical, for example, and has five flat faces 8, for example, on its periphery to allow a fluid, in particular a fuel, to flow past flat faces 8.

The injection valve is operated in a conventional manner, e.g., electromagnetically. An electromagnetic circuit, which includes, with a solenoid 10, an armature 11 and a core 12 serves to induce axial movement of valve needle 5 and thus to open the injection valve against the spring force of a restoring spring (not shown) or closes the injection valve. Armature 11 is connected to the end of valve needle 5 that faces away from valve closing body 7 with a weld produced with a laser, for example, and it is aligned with core 12.

A guide orifice 15 of a valve seat body 16 guides the valve closing body 7 during its axial movement. Valve seat body 16 which is cylindrical, for example, is mounted tightly by welding valve seat body 16 into the downstream end of valve seat carrier 1 facing away from core 12 in longitudinal orifice 3 concentric to longitudinal axis 2 of the valve. On its lower end face 17 facing away from valve closing body 7, valve seat body 16 is connected concentrically and fixedly to an orifice plate (e.g., nozzle plate) 21 which may be pot-shaped, for example, to be in direct contact with valve seat body 16. For example, a central outlet orifice 22 is made in orifice plate 21 by punching, eroding or etching process. A fluid having at least two streams with different directions of flow is sprayed out through the central outlet orifice 22 according to the present invention. This flow property is achieved by swirl-inducing means (arrangement) 23 positioned downstream from a valve seat face 29 and explained in greater detail below.

Valve seat body 16 and orifice plate 21 are connected, for example, by a first tight circumferential weld 25 produced by a laser. This type of assembly at least substantially diminishes an unwanted deformation of orifice plate 21 in its middle area with outlet orifice 22 and swirl-inducing means 23 arranged in that area. Orifice plate 21 is also attached to the wall of longitudinal orifice 3 in valve seat carrier 1 by e.g., a second tight circumferential weld 30.

The depth of insertion of the valve seat part in longitudinal orifice 3, consisting of valve seat body 16, pot-shaped orifice plate 21, and swirl inducing means (arrangement) 23 determines the length of the stroke of valve needle 5, because one end position of valve needle 5 is determined by the contact of valve closing body 7 with valve seat face 29 of valve seat body 16 when solenoid 10 is not energized. The other end position of valve needle 5 is determined, for example, by the contact of armature 11 with core 12 when solenoid 10 is energized. The stroke is thus the path between these two end positions of valve needle 5.

Spherical valve closing body 7 works together with valve seat face 29, tapering in a truncated conical form in the direction of flow, of valve seat body 16. Valve seat face 29 is formed upstream of swirl-inducing means 23 in the axial direction between guide orifice 15 and the bottom end face 17 of valve seat body 16. A partial view of the valve shown in FIG. 1 represents only one possible embodiment. The swirl-inducing means (arrangement) 23 according to the present invention may also be used with other, significantly different valves.

Figure 2A:
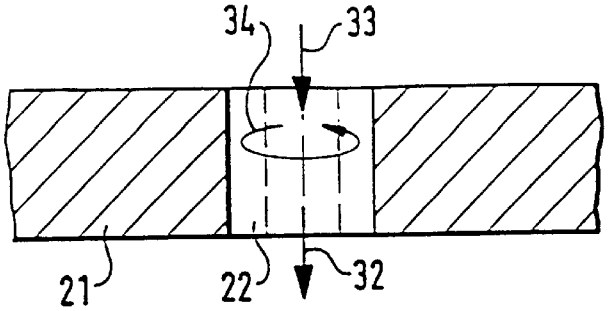
FIG. 2*a* shows a first idealized schematic diagram of flow patterns in an outlet orifice illustrated in FIG. 1.
Figure 2B:
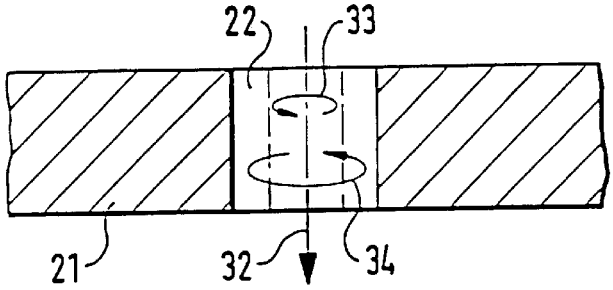
FIG. 2*b* shows a second idealized schematic diagram of the flow patterns in the outlet orifice illustrated in FIG. 1.

FIGS. 2*a* and 2*b* show schematic diagrams of the ideal flow patterns according to present invention in an outlet orifice 22 provided in orifice plate 21, for example. However, a pot-shaped orifice plate 21 shown in FIG. 1 is not required to achieve such flow patterns; instead, orifice plates 21 and nozzle plates may be designed with completely different contours. Outlet orifice 22 can also be provided directly in valve seat body 16 or a nozzle holder. As shown in FIGS. 2*a* and 2*b*, at least two flows of the fluid, specifically a fuel, run largely independently with a radial offset to one another and have different directions produced with swirl-inducing means (arrangement) 23 downstream of outlet orifice 22. A the theoretical direction of flow (direction of spray) of the two subcomponents in outlet orifice 22 along longitudinal axis 2 of the valve is substantially the same as that indicated by arrows 32. Thus, regardless of the general axial direction of flow 32, an internal flow component 33 has a direction being differing from that of an external flow having an external flow component 34 and surrounding radially the internal flow shown with dashed lines.

FIG. 2*a* illustrates a flow principle where the internal flow component 33, shown with dashed lines, substantially follows the axial direction of flow 32, while the fluid has an external flow component 34 characterized by a swirl component acting around the internal flow area. Internal flow component 33 is thus surrounded by an annular swirl flow of external flow component 34. In addition to external flow component 34, with the flow principle illustrated in FIG. 2*b*, internal flow component 33 also has a swirl which is produced by swirl-inducing means (arrangement) 23, although in the opposite direction from the direction of external flow component 34. Thus, two substantially independent, radially nested fluid flows 33, 34 runs in opposite directions in a swirl pattern flow through outlet orifice 22 in the axial direction of flow 32.

Figure 3:
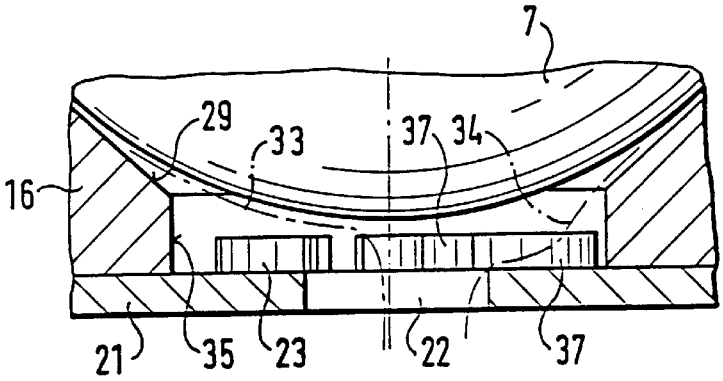
FIG. 3 shows a section through a first exemplary embodiment of the swirl-inducing means along line III—III in FIG. 5.
Figure 4:
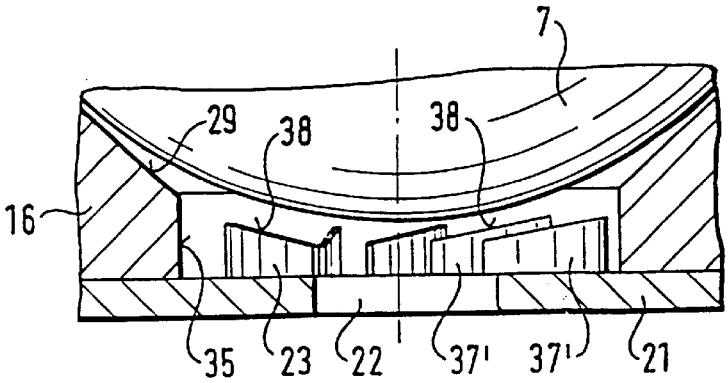
FIG. 4 shows a section through a second exemplary embodiment of the swirl-inducing means along line IV—IV in FIG. 5.
Figure 5:
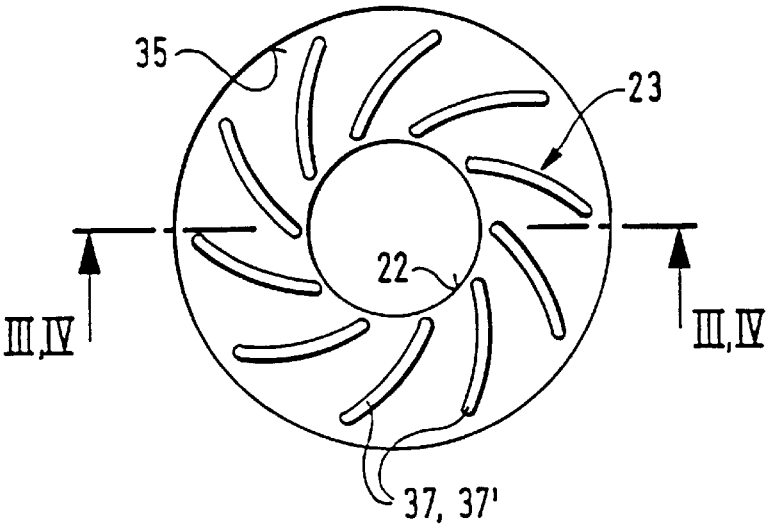
FIG. 5 shows a top view of the first exemplary embodiment of the swirl-inducing means illustrated in FIG. 3.

FIGS. 3–5 show various embodiments of swirl-inducing means (arrangement) 23 for achieving a flow principle illustrated in FIG. 2*a*. FIGS. 6–9 show various examples of swirl-inducing means (arrangement) 23 with which flow patterns illustrated in FIG. 2*b* can be achieved. FIGS. 3, 4 and 5 illustrate two examples of swirl-inducing means (arrangement) 23 which are designed as swirl elements on orifice plate 21 and which project into a cylindrical orifice area 35, downstream from valve seat face 29, of valve seat body 16 from the plane of orifice plate 21 in the direction of valve closing body 7. A top view shown in (FIG. 5) of swirl-inducing means (arrangement) 23 in the area of orifice area 35 illustrates the shape and arrangement of means 23 on orifice plate 21 FIGS. 3 and 4 show enlarged sectional views, respectively, along line III—III and IV—IV, in this top view illustrated in FIG. 5. In these embodiments according to the present invention, swirl-inducing means (arrangement) 23 are designed in the form of curved baffles 37, 37' arranged in a circular pattern around outlet orifice 22. For example, four to twenty of these baffles may be arranged in succession in the circumferential direction. On the whole, baffles 37, 37' yield an arrangement like a turbine blade wheel. The curved shape of baffles 37, 37' all in the same direction ensures that a swirl will be imparted to a fluid flowing therebetween. Baffles 37, 37' may extend almost from cylindrical orifice area 35 up to the internal outlet orifice 22 of orifice plate 21.

Baffle elements 37 of the embodiment illustrated in FIG. 3 have a constant axial height over the entire length of their curve, while baffles 37' shown in FIG. 4 have contours characterized by upper bordering sides 38 dropping radially from the outside to the inside toward outlet orifice 22. The drop in axial height of baffles 37' inward toward valve longitudinal axis 2 may be linear or exponential, for example.

In the two embodiments shown FIGS. 3 and 4, two main flows are induced in the fluid entering the orifice area 35 in an annular pattern downstream of valve seat face 29. FIG. 3 shows the paths for forming the two flow components 33 and 34. Flow component 33 is formed because a part of the fluid does not flow between the lower baffles 37, 37' directly downstream of valve closing body 7 but instead flows in the direction of internal outlet orifice 22 and enters it above baffles 37, 37' and thus without the imparted swirl. Another portion of the fluid flows into the areas between baffles 37, 37' where a swirl is imparted there to, thus yielding swirling flow component 34 enclosing the internal flow component 33. These arrangements yield the flow pattern shown in FIG. 2*a*. Baffles 37, 37' are designed in a single piece on orifice plate 21, for example, with conventional methods of electroforming (LIGA, MIGA methods) being especially suitable for its production. Widths of approx. 20 to 50 $\mu$m and axial heights of approx. 100 to 300 $\mu$m are conceivable orders of magnitude for baffles 37, 37'. These sizes are intended only to facilitate an understanding and in no way restrict the scope of the invention.

Figure 7:
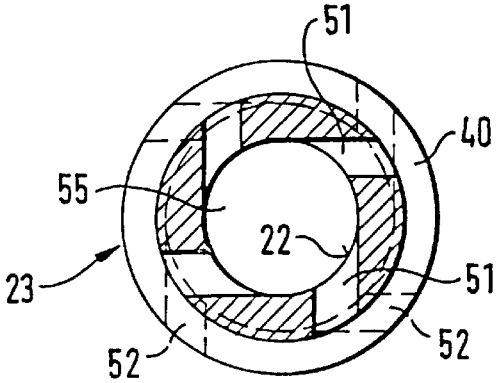
FIG. 7 shows a section through the swirl cap illustrated in FIG. 6 along line VII—VII.

Swirl-inducing means (arrangement) 23 shown in FIGS. 6–8 are, for example, swirl caps 40 which are manufactured separately from orifice plate 21 and are fixedly attached to orifice plate 21 by welding, soldering or gluing methods. However, swirl caps 40 may also be provided in one piece on orifice plate 21. Like baffles 37, 37', swirl caps 40 also project into orifice area 35 of valve seat body 16. Swirl caps 40 are parts characterized by two axially successive layers 41 and 42. Each layer 41, 42 serves as a function plane to produce a swirling 30 flow. The top layer 41 facing valve closing body 7 has a smaller outside diameter than the bottom layer 42 facing outlet orifice 22. Multiple, e.g., four, swirl channels 51, 52 run tangentially in each layer 41, 42, through the wall of stepped swirl cap 40, starting from the outer radial perimeter 35 and continuing up to an internal flow area 55 which is formed upstream of the outlet orifice 22 in the interior of swirl cap 40. Internal flow area 55 has a stepped design like the outside contour of swirl cap 40, i.e., flow area 55 has a smaller diameter in top layer 41 than in bottom layer 42. The internal flow component 33 is produced with swirl channels 51 of the top layer opening tangentially into flow area 55; swirl channels 52 in bottom layer 42 produce outer flow component 34 (see FIG. 2*b*). Swirl channels 51, 52 are provided with square or circular cross sections, for example. Swirl cap 40 is sealed toward valve closing body 7 by an upper boundary face 56, but is open toward outlet orifice 22.

FIG. 7 shows a section along line VII—VII in FIG. 6 through top layer 41 of swirl cap 40. FIG. 7 shows that swirl channels 51, 52 opening tangentially into flow area 55 have opposite orientations, so that two radially separate, oppositely swirling flow components 33, 34 are imparted to a fluid entering this area. This flow distribution produced in flow area 55 is largely retained in outlet orifice 22, so that increased shearing forces occurring in the bordering areas of the two flow components 33, 34 lead to turbulence which is particularly desirable to improve atomization of the fluid.

FIG. 8 shows another embodiment of a swirl cap 40 which differs slightly from swirl cap 40 shown in FIG. 6. A central pin 58 running axially is provided in this swirl cap 40 and, starting from boundary face 56, extends centrally through flow area 55 into outlet orifice 22. Pin 58 is designed in one piece on swirl cap 40, for example, or is secured to swirl cap 40 by welding, soldering or gluing. With this design of swirl cap 40, very good lamellar jet patterns, e.g., in the form of a hollow cone, can be produced. In addition, jet patterns in the form of solid cones are produced with the arrangement shown in FIG. 6. FIG. 9 shows a schematic diagram of an idealized radial velocity distribution over the diameter of the outlet orifice 22 downstream of swirl cap 40 shown in FIG. 6, which shows the opposite flow components 33 and 34.

What is claimed is:

1. A valve having a longitudinal axis and at least one outlet orifice, the valve comprising:

a valve closing body operably engaging with a valve seat face, wherein the at least one outlet orifice is situated downstream from the valve seat face;

an orifice plate containing the at least one outlet orifice; and a swirl-inducing arrangement situated upstream from the at least one outlet orifice, the swirl-inducing arrangement imparting first and second swirl flow components to a fluid, the first swirl flow component extending in a first swirl direction, the second swirl flow component extending in a second swirl direction, the first swirl direction being different from the second swirl direction, wherein the first swirl flow component at least partially extends at a radial offset from the second swirl flow component, wherein the first swirl flow component contacts the second swirl flow component at the at least one outlet orifice, and wherein the swirl-inducing arrangement is provided on the orifice plate, the orifice plate situated downstream from the valve seat face.

2. The valve according to claim 1, wherein the swirl-inducing arrangement includes a plurality of baffles, the plurality of baffles being arranged in an annular form and determining at least one of the first swirl direction of the first swirl flow component and the second swirl direction of the second swirl flow component.

3. The valve according to claim 2, wherein at least one of the plurality of baffles has a curved shape.

4. The valve according to claim 2, wherein the plurality of baffles have top boundary sides facing the valve closing body, and wherein a distance between the top boundary sides and the orifice plate radially decreases from an outside of the valve to an inside of the valve.

5. The valve according to claim 1, further comprising:

a swirl cap situated on the orifice plate and including the swirl-inducing arrangement.

6. The valve according to claim 5, wherein the swirl cap has an internal flow area for tangentially receiving openings of swirl channels, the swirl channels extending from a radial outer perimeter of the swirl cap.

7. The valve according to claim 6, wherein the swirl cap includes at least two layers, and the swirl channels are provided in the at least two layers, and wherein the swirl channels situated at a predetermined radial distance from the longitudinal axis of the valve are arranged in one of the at least two layers.

8. The valve according to claim 7, wherein the swirl channels situated in a first layer of the at least two layers have a first orientation, wherein the swirl channels situated in a second layer of the at least two layers have a second orientation, the first orientation being different from the second orientation.

9. The valve according to claim 6, wherein the swirl cap includes an axially extending central pin, the axially extending central pin extending through the internal flow area and at least partially projecting into the at least one outlet orifice.

10. The valve according to claim 1, wherein the valve is a fuel injection valve for a fuel injection system of an internal combustion engine.

* * * * *